United States Patent [19]

Gautier

[11] 4,377,192

[45] Mar. 22, 1983

[54] PITCHER-LIKE VESSEL WITH REINFORCED HANDLE

[75] Inventor: Raoul L. A. Gautier, Belmont sur Vair, France

[73] Assignee: Societe Generale des Eaux Minerales de Vittel, Vittel, France

[21] Appl. No.: 187,561

[22] Filed: Sep. 15, 1980

[30] Foreign Application Priority Data

Jan. 28, 1980 [FR] France ..... 80 02187

[51] Int. Cl.[3] ..... B65D 33/06

[52] U.S. Cl. ..... 150/12; 222/465 R

[58] Field of Search ..... 150/12; 222/465; 16/111 R; 190/57

[56] References Cited

U.S. PATENT DOCUMENTS

| | | | |
|---|---|---|---|
| 241,390 | 5/1881 | Mattson | 150/12 |
| 3,373,925 | 3/1968 | Gatward | 150/12 X |
| 3,722,786 | 3/1973 | Honn | 150/12 X |
| 4,209,116 | 6/1980 | Hendricks | 150/12 X |
| 4,210,244 | 7/1980 | Westrick | 150/12 X |

*Primary Examiner*—Donald F. Norton

*Attorney, Agent, or Firm*—Nathaniel A. Humphries

[57] ABSTRACT

A pitcher-like vessel formed of flexible plastic has a main cavity separated from a secondary cavity with a rigid body or mass of wood, plastic or the like in the secondary cavity permitting the use of same as a handle.

3 Claims, 8 Drawing Figures

PITCHER-LIKE VESSEL WITH REINFORCED HANDLE

French Pat. 75-18358 described and claimed a vessel made of a thin and flexible synthetic material, characterised by the fact that it comprises, in addition to the main cavity constituting the actual container, at least one closed pocket which does not communicate with the main cavity and is filled with a fluid rifidifying it. This pocket constitutes a gripping handle for the vessel. In the said patent, the liquid filling the secondary cavity is, for example, mineral water.

According to an embodiment, of said patent, the vessel is constituted by at least one bottom and two lateral walls formed by one or more thin films of flexible synthetic material which are welded along their juxtaposed edges, this vessel being characterised by the fact that its secondary cavity is separated from the main cavity by a continuous welded line joining two juxtaposed zones of the lateral walls.

With this design, the handle also imparts a certain rigidity to the vessel, even after the main cavity has been opened and partially emptied.

In a certificate of addition No. 78-04233, it has been proposed and claimed as another possible variation that the secondary cavity no longer be filled by a liquid but by a gas under pressure, for example compressed air.

Although all these embodiments give the expected results, an inherent disadvantage still remains in the fluid state of the element for filling the secondary cavity forming a handle. In fact, any perforation or imperfect welding at the level of the welded lines of the handle would allow the filling fluid to escape, making the vessel unsuitable for use in accordance with the proposed characteristics.

The present invention relates to various improvements for such vessels.

The invention proposes a vessel made of a thin and flexible synthetic material of the type comprising, in addition to its main cavity, a secondary cavity which does not communicate with the said main cavity, in which secondary cavity is incorporated a rigidifying means which imparts a certain rigidity to the vessel, particulary when its main cavity is being emptied, characterised in that the rigidifying means is a solid element.

The solid element used can be of any type such as, for example, cardboard, wood, a rigid synthotic material or any other equivalent.

According to a preferred embodiment, the solid element will be constituted by an expandable synthetic material which is injected into the secondary cavity in liquid form and solidifies by cooling at ambient temperature.

A material whose expansion temperature is much lower than the temperature of deterioration of the film constituting the container will preferably be selected.

A light, undeformable rigid handle which absorbs punching impacts without risk and thus eliminates any risk of leakage in thus obtained after cooling at embient temperature.

The present invention also relates to a method of injecting an expandable material into the secondary cavity forming the handle.

The invention will be understood better with the aid of the following description with reference to the attached drawings.

Figure 1:
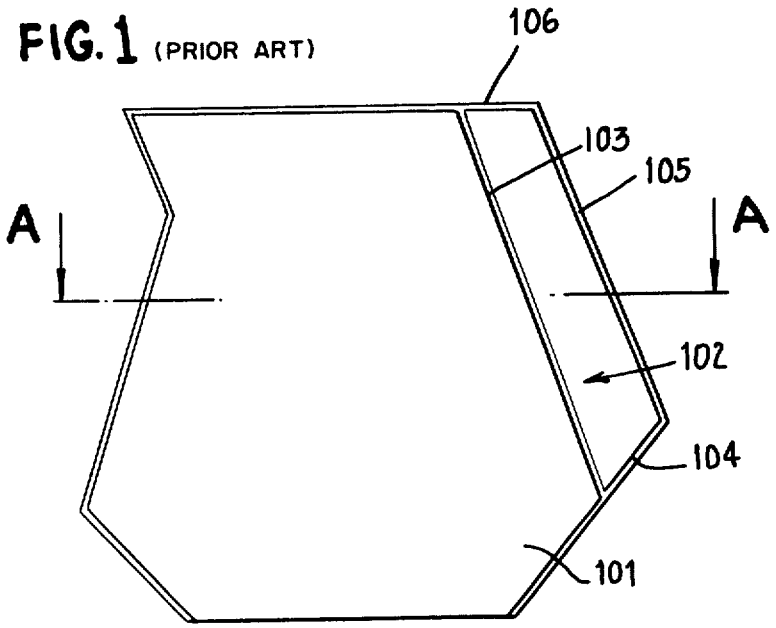
FIG. 1 (PRIOR ART)
FIG. 1 shows a schematic elevation of an embodiment of a vessel according to French Pat. 75-18358.
Figure 6:
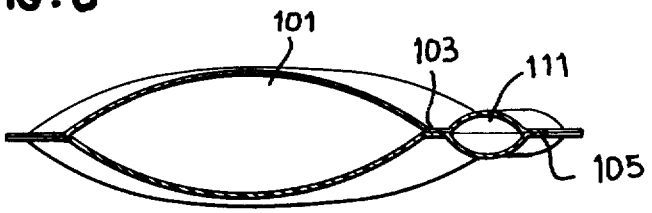
Figure 7A:
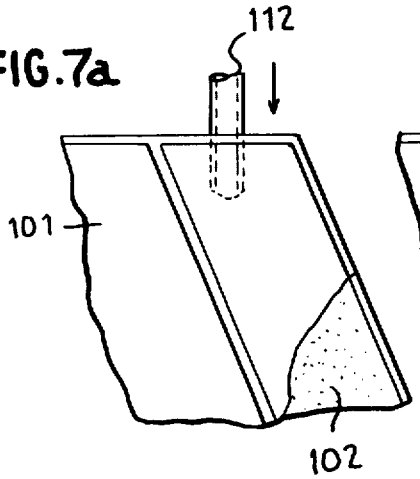
Figure 7B:
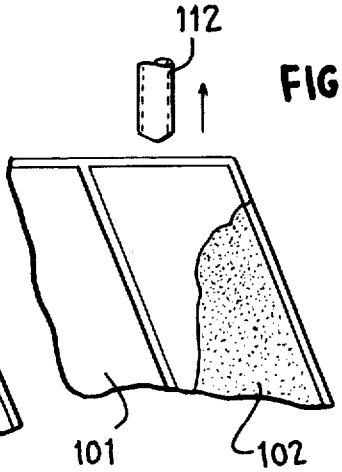

FIGS. *7a* and *7b* illustrate a method of obtaining a handle according to FIG. 6.

the vessel as shown schematically in FIG. 1 comprises a main cavity 101 and a secondary cavity 102. These two cavities are separated by a welded line 103, the secondary cavity also being defined by three other welded lines, 104, 105 and 106 respectively.

Figure 2:
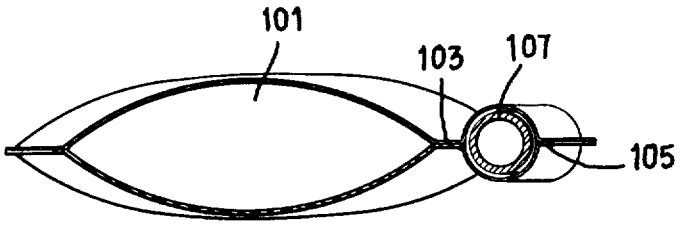
FIGS. 2, 3, 4, 5 and 6 illustrate by means of crossections along line A—A in FIG. 1 various embodiments of a solid element for rigidifying the handle.

In the embodiment in FIG. 2, a solid element 107 having a solid or hollow cylindrical cross-section and made of wood or cardboard or again of synthetic material is inserted into the cavity. It can be inserted through any of the sides of the handle, the weld being made later on in this case, for example the weld 105.

Figure 3:
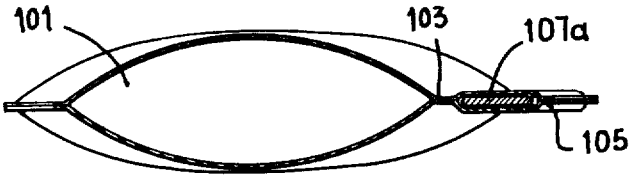

In the embodiment in FIG. 3, the solid element 107a is of the same type as in FIG. 2, but flat.

Figure 4:
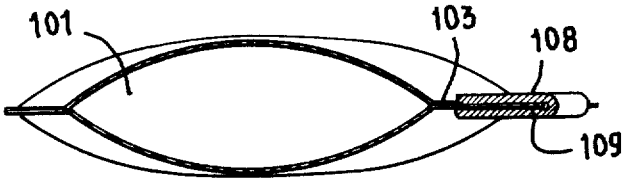

FIG. 4 shows a variation in which the solid U-shaped rigidifying element 108 encloses the cavity 102 which can also be eliminated here and replaced by a single film 109.

Figure 5:
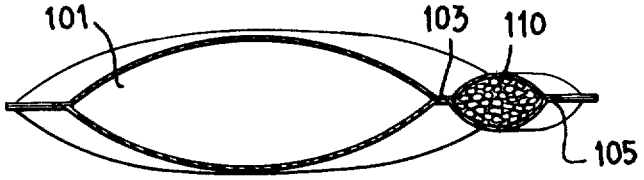

In the embodiment in FIG. 5, the cavity is filled with granules of synthetic material 110 through a filling orifice (not shown).

However, the most interesting embodiment is illustrated in FIG. 6 and the method of obtaining it in FIGS *7a* and *7b*. In this case, the cavity is filled with expandable foam material 111 which solidifies after expansion. For example, material 111 can be foamed polyurethane, polyesters or polyvinylchloride which is injected into the cavity along with a suitable conventional blowing (foaming) agent. This filling operation is carried out, for example, as follows:

(a) a needle 112 for supplying the expandable liquid synthetic material is introduced into the secondary cavity 102;

(b) the liquid material is injected;

(c) the needle is removed and, as a variation, either the orifice for passage of the needle is blocked immediately by welding the film forming the sachet, or the injected material is left to harden and to block this orifice itself.

It will be understood that the essential feature of the inventive idea underlying all the proposed embodiments essentially involves providing the handle with rigidifying means. The scope of the invention will not therefore be departed from by proposing, for example, that the two walls be welded or adhered completely or in part to form a handle having a certain rigidity due to the double film thickness at this level.

In this case, it is also possible to provide anatomical perforations for gripping the vessel as well as hooking holes for possible shop presentation.

Finally, this double thickness at the level of the handle could be achieved by using scraps obtained by cutting when producing the chain.

I claim:

1. A pitcher-like vessel formed of thin, flexible plastic comprising superimposed layers bonded together along weld lines to define a larger open-topped main cavity for receiving material to be held in the vessel and an elongated secondary cavity separated by a weld line from the main cavity and extending along a side edge of the vessel with the upper end of said secondary cavity being positioned adjacent the upper end of the vessel and the lower end of the secondary cavity being in the vicinity of the lower end of the vessel, elongated rigid solid reinforcing means extending internally along the length of the secondary cavity so as to substantially fill the secondary cavity so that the portion of the vessel enclosing the secondary cavity serves as a pouring handle without any aperture extending through the vessel between the portion serving as the pouring handle and portion defining the main cavity.

2. A pitcher-like vessel as recited in claim 1 wherein the elongated rigid solid reinforcing means is formed of wood, cardboard, or synthetic material.

3. A pitcher-like vessel as recited in either of claims 1 or 2 wherein the elongated rigid solid reinforcing means is of cylindrical cross-section.

* * * * *